United States Patent [19]

Furuyama

[11] Patent Number: 4,982,581

[45] Date of Patent: Jan. 8, 1991

[54] COUPLING DEVICE FOR ORNAMENTAL PIECE

[76] Inventor: Kazuo Furuyama, No. 27-7, Akane-cho, Kashiwa-shi, Chiba-ken, Japan

[21] Appl. No.: 471,442

[22] Filed: Jan. 29, 1990

[30] Foreign Application Priority Data

Oct. 3, 1989 [JP] Japan ..... 1-115820[U]

[51] Int. Cl.[5] ..... A44C 17/02

[52] U.S. Cl. ..... 63/29.1; 24/303

[58] Field of Search ..... 24/303, 590; 63/12, 63/13, 29.1, 26, 14.1, 14.3, 14.4, 14.5, 14.6, 14.8

[56] References Cited

U.S. PATENT DOCUMENTS 1,207,773 12/1916 Larson ..... 63/29.1
3,933,011 1/1976 DiGilio et al. ..... 63/29.1
4,622,726 11/1986 Nakamura ..... 24/303 X

FOREIGN PATENT DOCUMENTS 2332531 1/1975 Fed. Rep. of Germany ..... 24/590
1-164811 11/1989 Japan .

*Primary Examiner*—James R. Brittain
*Attorney, Agent, or Firm*—Armstrong, Nikaido, Marmelstein, Kubovcik & Murray

[57] ABSTRACT

According to the present disclosure, the base piece with an ornamental piece mounted thereon is coupled to the receiving member which is a part of any one of the various accessories or buttons by use of a magnetic coupling and through engagement of the projection in a special step-shaped engaging groove. Therefore, attachment and detachment of the ornament are easy and particularly, because the coupling requires a device which cannot be released by natural external forces while the device is in use, the ornamental piece is reliably prevented from dropping off of the base piece while in use and replacement of the ornamental piece by any of various accessories or ornamental buttons is easily and conveniently facilitated.

3 Claims, 3 Drawing Sheets

COUPLING DEVICE FOR ORNAMENTAL PIECE

BACKGROUND OF THE INVENTION

The present invention relates to a coupling device designed so that a jewel or any other ornamental piece can be readily replaced in accessory articles or ornamental buttons such as a finger ring, an earring, a brooch and the like.

In various accessories or ornamental buttons as described above, a commonly used coupling means permitting a base piece having a jewel or any other ornamental piece mounted thereon to be easily attached to and easily detached from a receiving member is used which magnetically or threadingly couples the base piece and the receiving member.

With a magnetic coupling in the prior art, attachment and detachment are easy, but there is a fear that the base piece may be relatively easily dropped off upon contact with another object. On the other hand, with a threading coupling, it is often difficult to perform the operation of turning both of the base piece and the receiving member several times in attaching and detaching them. Additionally, the machining work of threading a smaller part can be very troublesome.

The present invention provides a coupling device for an ornamental piece intended to overcome the disadvantages associated with the above prior art and uses both a magnetic coupling and means for preventing drop-off comprising a projection and an engaging groove to facilitate the attachment and detachment and to ensure a reliable and firm coupling.

The coupling device of this invention has a base piece adapted to have the ornamental piece mounted thereon and a receiving member to be coupled with the base piece, the base piece and the receiving member being coupled together by fitting and connecting a coupling portion of the base piece into a recess in the receiving member, wherein:

a step-shaped engaging guide groove is provided on the internal side surface of the recess of the receiving member, the engaging guide groove comprising an upper groove portion which communicates with a periphery of the surface having an opening of the recess and which extends towards the bottom of the receiving member, an intermediate groove portion which bends from the lower end of the upper groove portion and which extends along the circumferential direction, and a lower groove portion which bends from the remaining end of the intermediate groove portion towards the bottom of the receiving member, a projection provided on part of the external surface of the coupling portion is fitted into said step-shaped engaging guide groove and then turned and further pushed in the direction of coupling to thereby detachably couple the base piece and the receiving member, and magnet pieces are opposingly provided on the lower surface of the coupling portion and on the bottom surface of the recess.

Further, in the coupling device of this invention the shapes of the opening of the recess and of the bottom surface of the recess in the receiving member are formed identically, with the projected shape of the base piece having the projection on part of the external surface thereof.

Further, in the coupling device of this invention the shape of the bottom surface of the recess is formed identically with the projected shape of the base piece having the projection on part of the external surface thereof.

BRIEF DESCRIPTION OF THE DRAWINGS

The drawings illustrate embodiments of the present invention, wherein.

DETAILED DESCRIPTION OF THE PREFERRED EMBODIMENT

Figure 1:
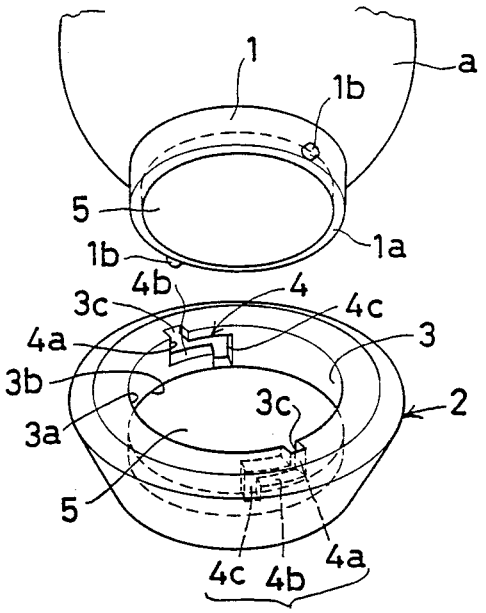
FIG. 1 is an exploded perspective view of a receiving member and a base piece.

In the present invention a base piece 1 having thereon an ornamental piece a is fitted at its coupling portion 1*a* into an opening 3*a* of the recess 3 of a receiving member 2, and the projection 1*b* is inserted into a step-shaped engaging guide groove 4 from the upper opening end of the upper groove portion 4*a*. The coupling portion 1*a* is then turned along the intermediate groove portion 4*b* and, at the end position thereof, is further pushed inwards along the lower groove portion 4*c* to non-rotatably connect the base piece 1 inside the recess 3. In this condition the base piece 1 and the receiving member 2 are magnetically connected to each other by means of the magnet pieces 5, 5.

In order to detach the base piece 1 from the receiving member 2 under this condition, an operation which is opposite in sequence to the coupling operation described above must be performed, namely, by first pulling the base piece 1 along the lower groove portion 4*c* against the magnetic coupling force, then turning it along the intermediate groove portion 4*b* in the direction opposite to that used for coupling the base piece 1 and further pulling the projection lb out of the upper groove portion 4*a*. However, it is highly unlikely, if not impossible, that the operation of pulling the base piece 1 upwards against the magnetic coupling force, then turning it and further pulling it out of the recess in the mentioned sequential order could occur due to natural external forces while the ornamental piece a is in use. Such operation is performed only manually and, therefore, the base piece 1 cannot be inadvertently dropped off from the receiving member 2 while in use. This ensures the coupling of the base piece 1 to the receiving member 2.

For connecting the base piece 1 and the receiving member 2, the opening 3*a* of the recess 3 of the receiving member 2 can be formed in the same shape as the projected shape of the coupling portion 1*a* of the base piece 1 as well as having a projection 6 on part of its external surface. In this manner, the fitting and connecting movements of the connecting portion 1*a* relative to the recess 3 is facilitated. Further, as a result of a complementary fitting and secure connection between the step-shaped engaging guide groove 4 and the projection 1*b*, the coupling portion 1*a* contacts the bottom surface 3*b* of the recess 3 wherein the coupling portion 1*a* and the bottom surface 3*b* are connected together without clearance in between due to the complementary shapes of both, thereby securing a firm connecting condition. In this case it is preferable that at least the bottom surface 3*b* of the recess 3 be formed in the same shape as the coupling portion 1*a* to secure a firm connection.

Figure 9:
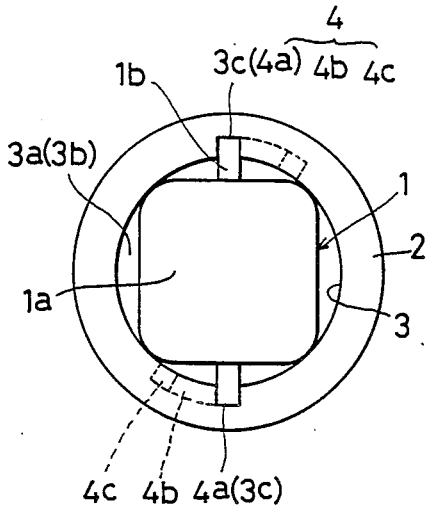
FIG. 9 is a top plan view of another embodiment of this invention.

However, the relative shapes of the coupling portion 1*a* and the recess 3 need not necessarily be the same; as illustrated in FIG. 9, for example, the coupling portion 1*a* and the recess 3 may have different shapes from each other provided that the coupling portion la may be able to rotate within the recess 3 without large deviation of the coupling portion from its predetermined position. Accordingly, it is still possible to detachably connect the coupling portion 1*a* and recess 3 together even though they differ in shape.

Figure 2:
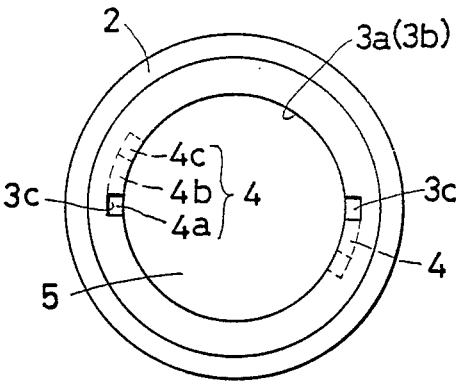
FIG. 2 a top plan view of the receiving member.

An embodiment of the present invention will now be described with reference to FIGS. 1 and 2.

Reference numeral 1 denotes a base piece having a jewel or any other accessory piece *a* integrally mounted thereon, and reference numeral 2 denotes a receiving member to which the base piece 1 is coupled. In the illustrated embodiment, the receiving member 2 is a component of the accessory and is used in combination with the base piece 1 fitted into and connected within a recess 3 provided in the receiving member 2.

On the coupling portion 1*a*, which is inserted into the recess 3 of the receiving member 2, there are provided projections 1*b* comprising projectingly mounted pins on part of its external surface. The opening 3*a* and the bottom surface of the recess 3 of the receiving member 2, into which the coupling portion 1*a* of the base piece 1 is inserted, are formed in a complementary shape to the projected shape of the coupling portion 1*a* including the projections 1*b* for receiving the same.

The base piece 1 and the coupling portion 1*a* of the illustrated example are integrally combined together. The cross section of the base piece 1 is circular with projections 1*b* formed in diametrically opposite positions. In the opening 3*a* and in the bottom surface 3*b* of the recess 3 of the receiving member 2, openings (slots) 3*c* which conform to the projections 1*b* for receiving the same are formed in the circular edges.

On the internal circumferential surface of the recess 3 there are provided step-shaped engaging guide grooves 4 each of which comprises an opening (slot) 3*c* as an upper opening on the upper circumferential edge, an upper groove portion 4*a* which extends from the opening 3*c* towards the bottom, an intermediate groove portion 4*b* which bends from the end of the upper groove and which extends along the circumferential direction, and a lower groove portion 4*c* which bends from the remaining end of the intermediate groove portion and which extends further towards the bottom.

The number of the projections 1*b* and the step-shaped engaging guide grooves need not be limited to two pieces as illustrated, and may be increased or decreased at will.

Figure 3:
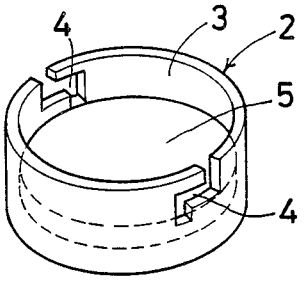
FIG. 3 perspective view of another embodiment of the receiving member.

The provision of the engaging guide groove 4 may be modified, for instance, as shown in FIG. 3. Namely, with a receiving member 2 which is cylindrically formed, the engaging groove 4 may be provided through the entire depth of the wall of the receiving member 2.

Further, magnet pieces 5 are mounted respectively on the lower end face of the coupling portion 1*a* of the base piece 1 and on the bottom surface 3*b* of the recess of the receiving member 2, so that they may be in contact with each other or may be opposed in close proximity to each other when both are fitted and connected together.

In the above construction, the coupling portion 1*a* of the base piece 1 is fitted into the recess 3 of the receiving member 2, and the projections 1*b* of the coupling portion 1*a* are placed into the opening (slot) 3*c*. The coupling portion 1*a* is then inserted in the upper groove portion 4*a* of the step-shaped engaging groove 4, is turned along the intermediate groove portion 4*b* and then, at the end of the intermediate groove portion 4*b*, is pushed in the direction of fitting, thereby firmly connecting the base piece 1 inside the recess 3 of the receiving member 2 by means of magnetic connection between magnet pieces 5, 5 provided on the end surface of the coupling portion 1*a* and on the bottom surface 3*b* of the recess 3.

Figure 4:
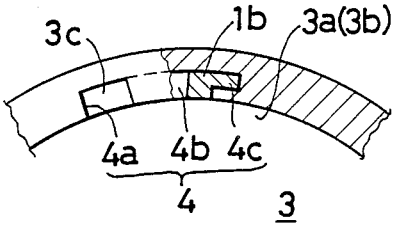
FIG. 4 is a top plan view, partly in section, of a part of the receiving member.
Figure 6:
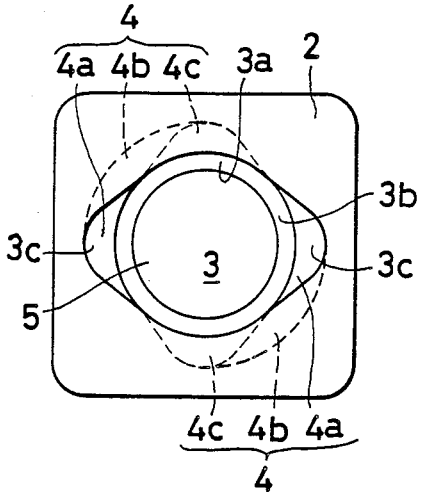
FIG. 6 is a top plan view of a receiving member of the embodiment shown in FIG. 5.
Figure 7:
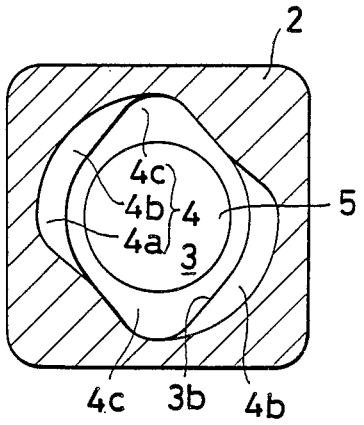
FIG. 7 is a sectional view taken along the line VII—VII in FIG. 5.
Figure 8:
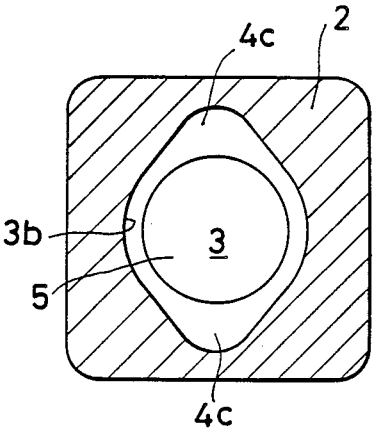
FIG. 8 is a sectional view taken along the line VIII—VIII in FIG. 5.

If there occurs some looseness in the joint between the base piece 1 and the receiving member 2, the secureness of the coupling becomes uncertain. However, any looseness in the joint can be eliminated and the connection secured if those projections 1*b* on the coupling portion 1*a* are formed, for example, into a hook shape, and the cross section of the lower groove portion 4*c* of the engaging guide groove 4 into which the projections 1*b* are inserted is made to coincide with such hook-shaped projections 1*b* as illustrated in FIG. 4. The shape of the above-mentioned projections 1*b* need not be limited to a hook shape; they may be formed in a T-shape or any other shapes at will. Accordingly, the sectional shape of the lower groove portion 4*c* of the engaging guide groove 4 is formed so as to correspond to the shape of the projections 1*b*.

Another embodiment of the present invention will be described below with reference to FIGS. 5 through 8.

Figure 5:
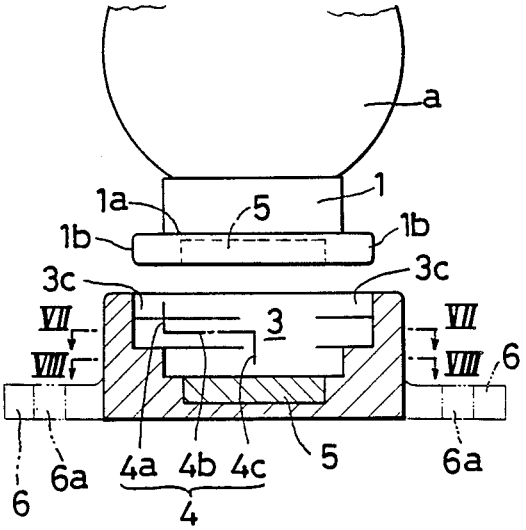
FIG. 5 is a side view of another embodiment of this invention with an essential portion being in section.

In this embodiment, the coupling portion 1*a* of the base piece 1 is formed into a shape having two projections 1*b* on the periphery. Therefore, the recess 3 of the receiving member 2 is formed correspondingly such that the opening 3*a* in the recess 3 and the bottom surface 3*b* have the same shape as that of the peripheral shape of the coupling portion 1*a*. Further, as illustrated in FIG. 5, a step-shaped engaging guide groove 4 is formed on the internal circumferential surface in communication with the openings (radially extending slots) 3*c* in the recess so that the coupling portion 1*a* of the base piece 1 is inserted into the recess 3 of the receiving member 2 by aligning the projections 1*b* and the opening 3*c* and then is turned and is further pushed in the direction of fitting. This operation of the embodiment is not different from the foregoing embodiment.

In the embodiments as shown in FIGS. 1 through 8, there are shown examples in which the projected shapes of the coupling portion 1*a* and at least of the bottom surface 3*b* of the recess 3 are made identical. However, as illustrated in FIG. 9, the shape of the coupling portion 1*a* may be rectangular or any other arbitrary shape, and the shape of the recess 3 into which the coupling portion 1*a* is inserted may be circular or any other shape in which the coupling portion 1*a* can be freely rotatable. In this case, although it is preferable that the coupling portion 1*a* is rotatable within the recess 3 in contacting relationship with the internal surface of the recess 3, the projections 1*b* and the engaging guide groove 4 may have some allowance for movement so long as they remain within a range in which they are not apart from each other.

Figure 10:
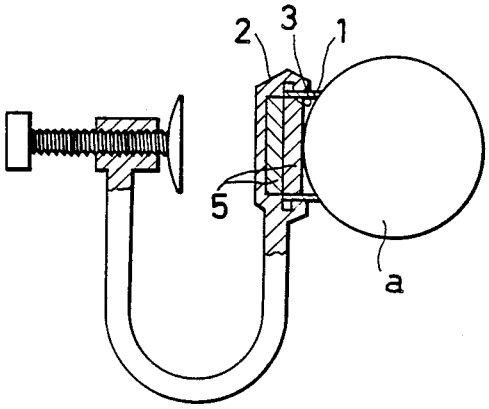
FIG. 10 a side view, partly in section, illustrating one example of using the device according to this invention.

FIG. 10 illustrates an earring in which the coupling device of the present invention is employed, wherein a base piece 1 with an ornamental piece mounted thereon is replaceably coupled to a receiving member 2 which is a component of the earring. Of course, it will be understood that the ornamental piece *a* can be replaced by any other pieces used for various accessories. In addition, the receiving member 2 may be attached to articles of clothing or the like and the base piece 1 with an ornamental piece a mounted thereon may be connected to the receiving member 2 in the above-described manner, thereby providing a button which can be used with various ornamental pieces a, replaced or substituted by other ornaments as required.

The attachment of the receiving member 2 to articles of clothing can be achieved by any method, for example, by sewing, using holes 6*a* in sleeves 6 mounted on the receiving member 2 as shown by phantom line in FIG. 5, or by inserting claws (not shown) projecting from the receiving member 2 through the clothing and folding them back.

We claim:

1. A coupling device for an ornamental piece comprising a base piece adapted to mount the ornamental piece thereon and a receiving member for coupling with said base piece, said base piece and said receiving member being coupled together by fitting and connecting a coupling portion of said base piece into a recess of said receiving member, comprising:

a step-shaped engaging guide groove provided on the internal side surface of said recess of said receiving member, said engaging guide groove comprising an upper groove portion which communicates with a periphery of the surface having an opening of said recess and which extends towards the bottom of said receiving member, an intermediate groove portion which bends from the lower end of said upper groove portion and which extends along the circumferential direction, and a lower groove portion which bends from the remaining end of said intermediate groove portion towards the bottom of said receiving member, a projection provided on part of the external surface of said coupling portion for fitting into said step-shaped engaging guide groove and then being turned and further pushed in the direction of coupling to thereby detachably couple said base piece and said receiving member, and attracting magnet pieces opposingly provided on the lower surface of said coupling portion and on the bottom surface of said recess.

2. The coupling device for an ornamental piece as defined in claim 1, wherein the shapes of the opening of said recess and of the bottom surface of said recess in said receiving member are formed identically with the projected shape of said base piece having the projection on part of the external surface thereof.

3. The coupling device for an ornamental piece as defined in claim 1, wherein at least the shape of the bottom surface of said recess in said receiving member is formed identically with the projected shape of said base piece having the projection on part of the external surface thereof.

* * * * *